US007347771B2

(12) United States Patent
Wentworth et al.

(10) Patent No.: US 7,347,771 B2
(45) Date of Patent: Mar. 25, 2008

(54) FLAP-TYPE ROTARY FINISHING DEVICE

(76) Inventors: Robert J. Wentworth, 37924 Stableview, Farmington Hills, MI (US) 48335; Douglas J. Calvin, 14414 Barbara, Livonia, MI (US) 48154

( * ) Notice: Subject to any disclaimer, the term of this patent is extended or adjusted under 35 U.S.C. 154(b) by 0 days.

(21) Appl. No.: 11/381,785

(22) Filed: May 5, 2006

(65) Prior Publication Data

US 2006/0246829 A1 Nov. 2, 2006

Related U.S. Application Data

(63) Continuation of application No. 11/196,054, filed on Aug. 3, 2005, which is a continuation of application No. 10/707,780, filed on Jan. 12, 2004, now Pat. No. 6,949,019.

(51) Int. Cl.
*B24B 9/02* (2006.01)

(52) U.S. Cl. ..... 451/466; 451/469; 451/490

(58) Field of Classification Search ..... 451/463, 451/464, 466–469, 490, 496, 497
See application file for complete search history.

(56) References Cited

U.S. PATENT DOCUMENTS 3,212,210 A 10/1965 Schmelzer, Jr.
3,648,417 A * 3/1972 Block ..... 451/469
3,678,633 A * 7/1972 Block ..... 451/469
3,747,285 A * 7/1973 Block ..... 451/469
3,872,630 A 3/1975 Ali
3,890,746 A 6/1975 Saegusa et al.
4,004,316 A 1/1977 Ali
4,018,014 A * 4/1977 Belanger ..... 451/469
4,080,714 A 3/1978 Emerson
4,183,183 A 1/1980 Belanger
4,217,737 A 8/1980 Hasegawa
4,258,509 A 3/1981 Wray et al.
4,365,448 A 12/1982 Wilson
4,872,292 A 10/1989 Block
5,233,719 A 8/1993 Young et al.
5,295,332 A 3/1994 Tyler et al.
5,423,718 A 6/1995 Tyler et al.
5,554,068 A 9/1996 Carr et al.
6,217,431 B1 4/2001 Brinkmann
6,592,442 B2 7/2003 Hoffheimer
6,595,843 B1 7/2003 Weber
2003/0092370 A1 5/2003 Lundum

* cited by examiner

*Primary Examiner*—Dung Van Nguyen
(74) *Attorney, Agent, or Firm*—Dickinson Wright PLLC

(57) ABSTRACT

A rotary finishing device including a generally circular hub having an inner periphery and an outer periphery. The outer periphery includes a plurality of slots formed thereabout, which are defined by a pair of side portions. The plurality of slots are generally uniformly spaced about the outer periphery of the hub. Each of the slots has at least one finishing sheet secured therein by an adhesive.

24 Claims, 13 Drawing Sheets

FLAP-TYPE ROTARY FINISHING DEVICE

CROSS-REFERENCE TO RELATED APPLICATIONS

The present application is a continuation-in-part of currently pending U.S. patent application Ser. No. 11/196,054, filed on Aug. 3, 2005, and entitled "Rotary Finishing Device," which is a continuation of U.S. patent application Ser. No. 10/707,780, filed on Jan. 12, 2004, and entitled "Flap-Type Rotary Finishing Device," which is now U.S. Pat. No. 6,949,019.

BACKGROUND OF THE INVENTION

The present invention relates generally to a rotary finishing device, and more particularly to a flap-type rotary finishing device having an epoxy attachment of the finishing media to a hub of the flap wheel.

Rotary finishing tools are well known and typically include pieces or strips of a finishing medium. Such tools have proven to be very effective in the finishing of a wide variety of components such as those made from metal or the like. An exemplary rotary finishing tool utilizes generally rectangular pieces of abrasive paper, such as sandpaper, to provide a rotary abrasive device.

One of the more common rotary finishing tools or devices is known in the art as a flap wheel. These flap wheels typically have annular arrays of flexible finishing strips and are commonly used in the finishing art. Most conventional rotary finishing devices consist of flexible strips each comprising sheets of material for finishing a surface of a piece. Many of these rotary finishing devices have abrasive particles bonded on one face thereof. Such rotary abrasive devices are useful for contoured polishing, cutting, or surface abrading of a variety of metal surfaces.

Various fabrication methods for such a rotary device are known. One such conventional method requires that the finishing sheets have two notches in their opposite side edges near the base end of each strip. As the strips are arranged in an annular array, the notches form concentric circular depressions on opposite sides of the annular array. Suitable circular reinforcement mechanisms, such as two metallic end caps are mounted on opposite sides of the array. Each end cap has an inwardly extending lip, which engages the circular depressions to mechanically grip the inner ends of the finishing strips. This method thus relies on friction created between the two metallic end caps to maintain the base ends of the strips in contact with a hub of the rotary device. Although a rotary finishing device of this configuration performs suitably, its manufacture is rather expensive and requires two notches to be formed in each strip prior to assembly. The forming of these notches is both time consuming and costly. Further, the notches must be aligned properly with respect to each other to receive accurate placement of the metal end caps.

Another known fabrication method for a rotary finishing device involves attaching the strips to an aluminum clip, such as by stapling. The metal clip with the attached strips is then loaded into a metal hub. A plurality of pins are then used to secure the hub to an end cap. These pins maintain the strips in communication with the metal hub, such that it is relatively difficult for the strips to become disengaged from the hub during polishing. However, these rotary devices are also relatively expensive and also require a relatively cumbersome assembly process.

Yet another known fabrication process involves attaching the finishing media through the use of a suitable adhesive. This adhesive, such as an epoxy, is applied to the strips at their base ends to bond them to one another to form a unitary structure. The adhesive itself thus becomes the hub. Alternatively, a cardboard center is utilized to control the flow of adhesive. While these rotary devices are relatively inexpensive to produce, they are prone to breakage issues after high use. This breakage typically occurs due to failure of the epoxy, which is the weakest part of the device, as a result of the application of significant force during usage. When this breakage or failure of the rotary device occurs, a portion of the epoxy, together with the adhered strips, typically separates from the device. This results in an imbalanced rotary device, which requires replacement. Additionally, when the breakage occurs, because of the relatively high operating speeds of these devices, the separated portion can become a projectile, which can raise safety concerns or cause damage to the finishing device or surrounding apparatus.

Therefore, a need exists for a rotary finishing device that is relatively inexpensive to manufacture, but has sufficient strength to withstand the high operating speeds to which these devices are subjected.

SUMMARY OF THE INVENTION

One advantage of the present invention is to provide a rotary finishing device that is less expensive than prior rotary finishing devices.

Another advantage of the present invention is to provide a rotary finishing device that decreases the assembly time of the device without compromising its strength or integrity.

Yet another advantage of the present invention is to provide a rotary finishing device that can be more inexpensively manufactured for a wide variety of different applications.

A further advantage of the present invention is to provide a rotary finishing device that can be manufactured in a variety of different widths and lengths.

Still another advantage of the present invention is to provide a rotary finishing device that decreases the associated machining time.

Yet a further advantage of the present invention is to provide a rotary finishing device that can be readily adapted to drive shafts or devices of varying sizes.

Still yet another object of the present invention is to provide a rotary finishing device that provides for increased retention of an attached finishing medium.

In accordance with the above and the other advantages of the present invention, a rotary finishing device is provided. The rotary finishing device includes a generally circular hub having an inner periphery and an outer periphery. The inner periphery defines a passageway therethrough. The outer periphery of the hub has a plurality of slots extending therefrom. Each of the plurality of slots is defined by a pair of side portions. Additionally, the plurality of slots are generally uniformly spaced around the outer periphery. Each of the plurality of slots includes a finishing media secured therein. The finishing media is secured within each of the plurality of slots by an adhesive. Each of the side portions has a tip portion that is narrower than the width of the remaining part of the side portions.

A method in accordance with the above and the other advantages of the present invention includes providing a generally circular hub having an inner periphery and an outer periphery. The outer periphery of the hub has a plurality of slots formed therein. The surface of the outer periphery is subjected to a surface treatment to assist in bonding a finishing media thereto by an adhesive.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Referring now to the Figures, which illustrate various embodiments of a rotary finishing device in accordance with the present invention. The rotary finishing devices can be utilized to finish a surface, such as by polishing, abrading or the like. However, it will be understood that the finishing devices disclosed herein can be utilized for a variety of different purposes and can be formed with a variety of different configurations. Moreover, the finishing media utilized with the disclosed finishing devices can also vary depending upon the application for which the finishing devices will be used and can include cloth, sandpaper or the like. It will also be understood that a variety of different finishing media may be utilized.

Figure 1:
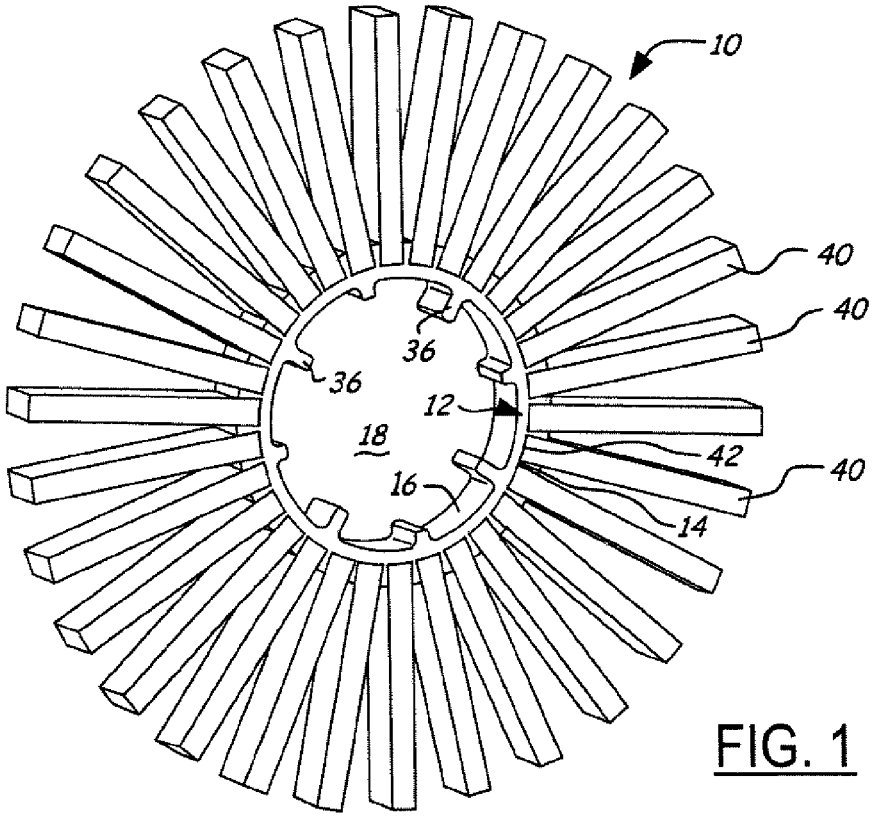
FIG. 1 is a perspective view of a flap wheel, in accordance with one embodiment of the present invention.
Figure 2:
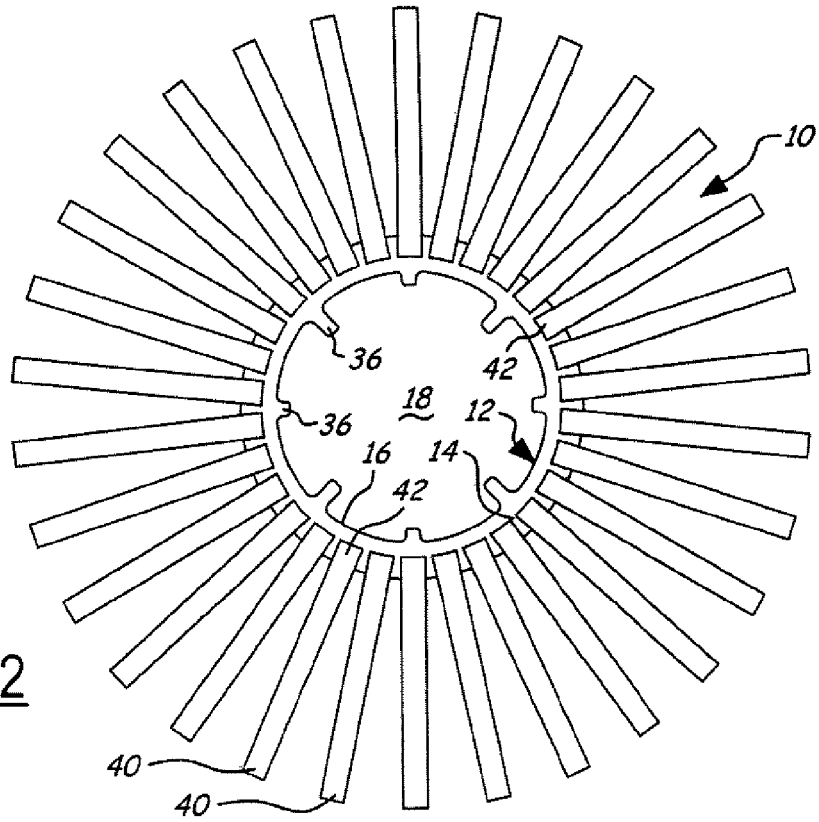
FIG. 2 is a front view of the flap wheel shown in FIG. 1.
Figure 3:
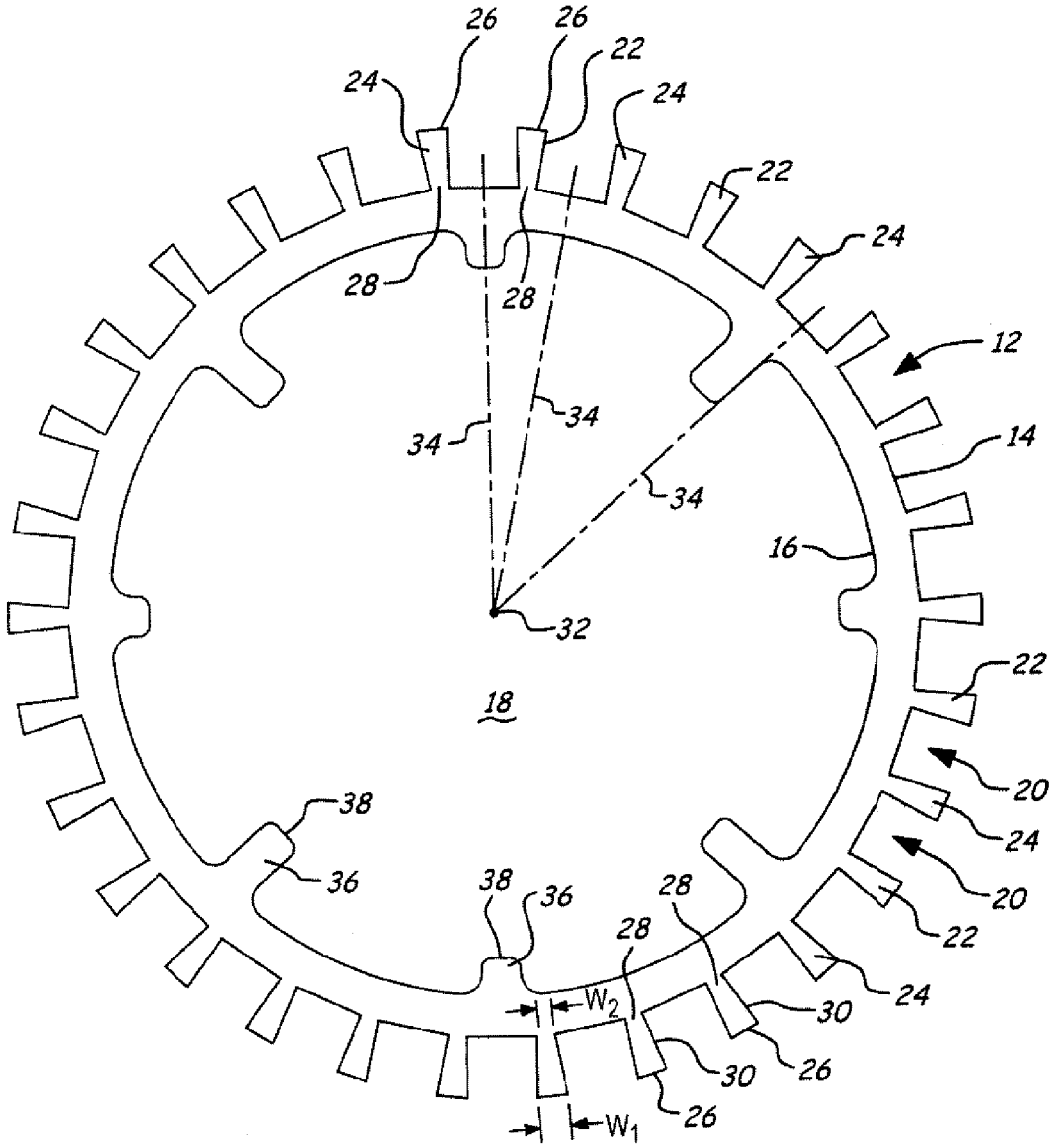
FIG. 3 is a front view of a generally cylindrical hub of the flap wheel shown in FIG. 1.

Turning now to FIGS. 1 through 3, which illustrate one embodiment of a rotary finishing device in accordance with the present invention. The rotary finishing device 10 includes a generally circular hub 12, having an outer peripheral surface or outer periphery 14, and an inner peripheral surface or inner periphery 16. The inner periphery 16 defines a passageway or throughway 18 that is preferably open to either side of the device 10. The circular hub 12 is preferably formed from a metal, such as aluminum. However, it will be understood that a variety of other materials may also be utilized, including plastic. Further, the circular hub 10 is preferably formed by an extrusion process. However, again a variety of other processes may also be utilized to form the circular hub 12. The hubs can be formed with a variety of different diameters, widths, lengths and other configurations. This flexibility is not present in current devices, i.e. the ability to provide hubs of varying lengths.

The outer periphery 14 of the device 10 includes a plurality of slots 20 formed thereabout. In this embodiment, the slots 20 are defined by a pair of side portions 22, 24 that extend generally outward from the outer periphery 14. It will be understood that the side portions 22, 24 of each of the slots 20 can extend in a variety of different directions, including inwardly. As shown best in FIG. 3, each side portion 22, 24 includes a tip portion 26, a base portion 28, and a side surface 30 extending between the base portion 28 and the tip portion 26. In this embodiment, the tip portions 26 have a greater width (w1) than the width (w2) of the base portions 28. This orientation assists in maintaining the side surfaces 30 generally parallel to one another such that each slot 20 is generally square or rectangular in shape.

Additionally, the circular hub 12 has a center point or centerline 32, which corresponds to the axis of rotation of the device 10. A reference line exists that extends from the center point 32 to a point between the pair of side portions 22, 24, as is identified by number 34. When the reference line 34 continues outwardly it passes between each of the side portions 22, 24. Here, the side surfaces 30 lie generally parallel to the reference line 34. This provides side portions 22, 24 that are oriented generally perpendicular to the outer periphery 14 of the hub 12.

Each of the slots 20 includes a finishing media 40 disposed therein. The finishing media 40 may be comprised of a single sheet of material or a plurality of sheets of material.

The finishing media 40 is intended to contact a surface to be finished. The finishing media is disposed between a pair of side portions 22, 24 and its innermost portion 42 is located adjacent the outer periphery 14 of the device 10. In one embodiment, the finishing media 40 is secured within each of the slots by an adhesive, such as an epoxy. The adhesive is utilized to secure the finishing media within each slot 20 by affixing it to the outer periphery 14 of the hub 12 and the opposing side surfaces 30 of each of the side portions 22, 24. Obviously, the finishing media can be secured within each of the slots in a variety of suitable manners.

In accordance with one embodiment of the present invention, the outer periphery 14 of the hub 12 and the opposing side surfaces 30 of each of the side portions 22, 24 are subjected to a surface treatment prior to attachment of the finishing media within each slot 20. The surface treatment roughs up, abrades, or otherwise prepares the contact surface to assist in adhering the finishing media to the hub 12. It will be understood that all or fewer than all of the contact surfaces may be subjected to the surface treatment. The surface treatment includes etching, sand blasting, vibratory finishing, and a surface finish. It will be understood that other suitable surface treatments or surface finishings may be utilized.

Figure 14:
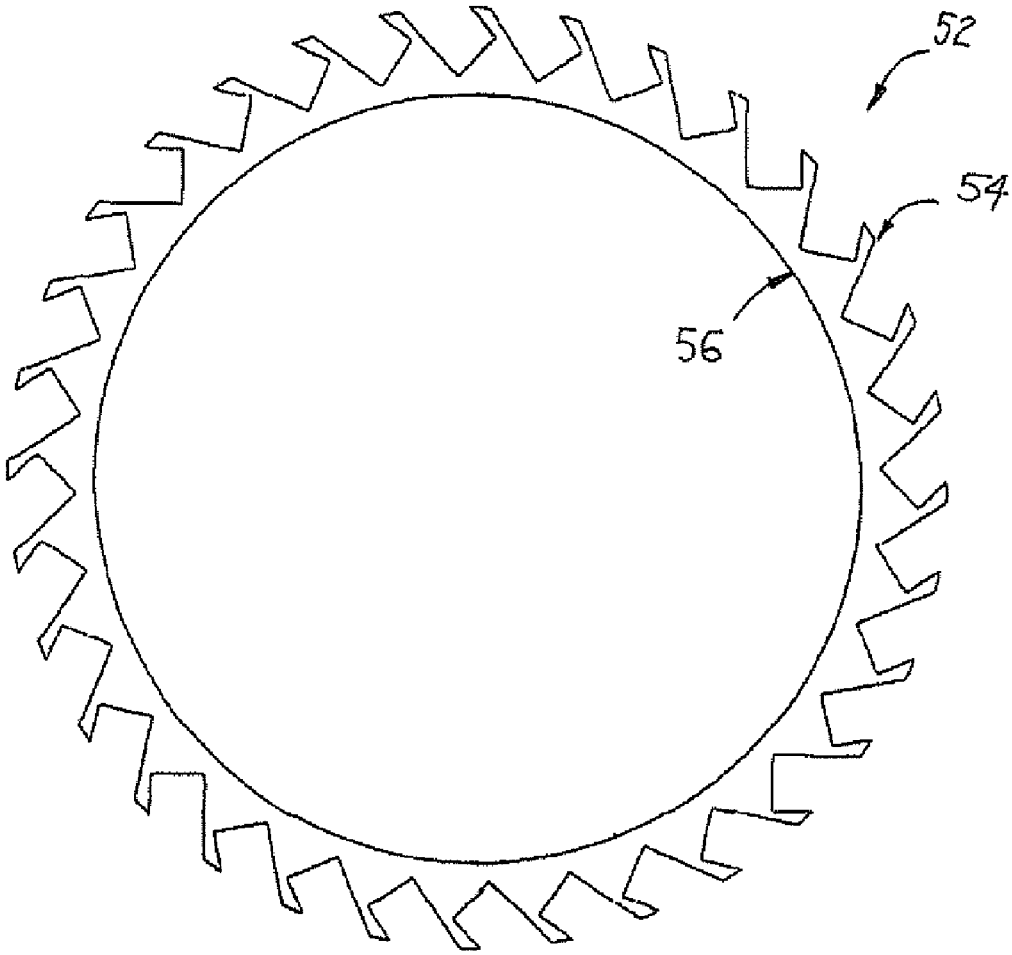
FIG. 14 is a front view of a cylindrical hub for a flap wheel in accordance with yet a further embodiment of the present invention.

The inner periphery 18 of the device 10 also includes a plurality of lugs 36 that extend generally inwardly therefrom. The lugs 36 allow for easy machining of the device 10 to true up the inside contact surface, by removing a certain portion of material from the tip 38 of at least some of the lugs 36. This provides significant material savings as well as a decrease in machining cost as only the lugs 36 require machining instead of the entire inner periphery 18 when that is used as the contact surface to drive the finishing device. The lugs 36 also allow the hub 12 to communicate with a shaft or end cap to allow easy driving thereof. It will also be understood that the lugs 36 allow the hub 12 to be extruded in an almost infinite number of sizes, i.e. lengths and diameters. Further, by adjusting the lengths of the lugs 36, i.e. the amount they extend inwardly, the hub can be utilized with a variety of different sized driving shafts. It will be understood that the inner periphery 18 may alternatively be a generally smooth surface without any lugs 36. Moreover, any number of lugs may be utilized. For example, FIG. 14 illustrates a generally circular hub 52 having an outer periphery 54 and an inner periphery 56. The inner periphery 56 does not have any lugs, but instead is comprised of a smooth surface.

Figure 4:
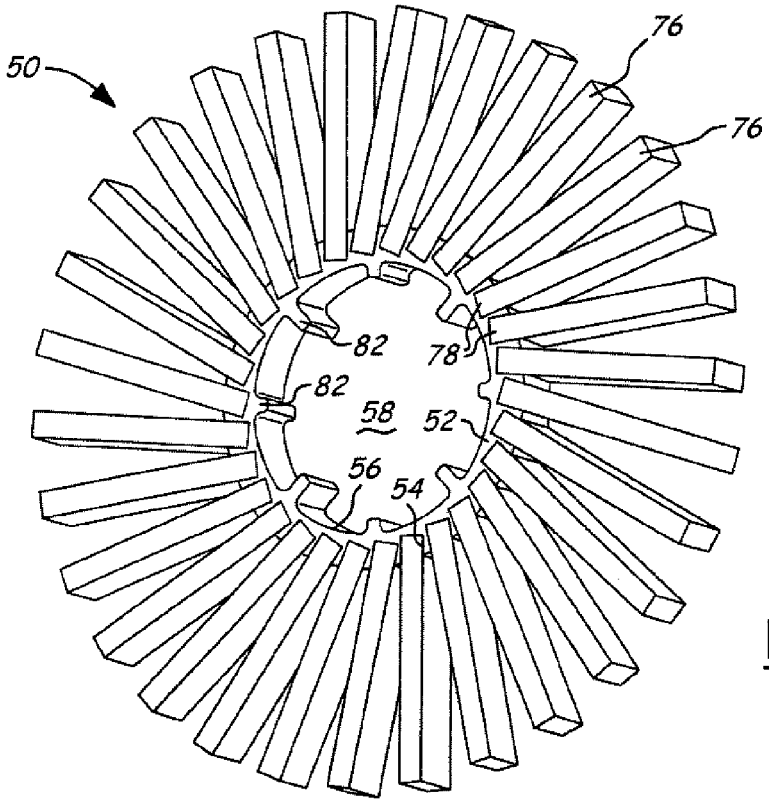
FIG. 4 is a perspective view of a flap wheel in accordance with another embodiment of the present invention.
Figure 5:
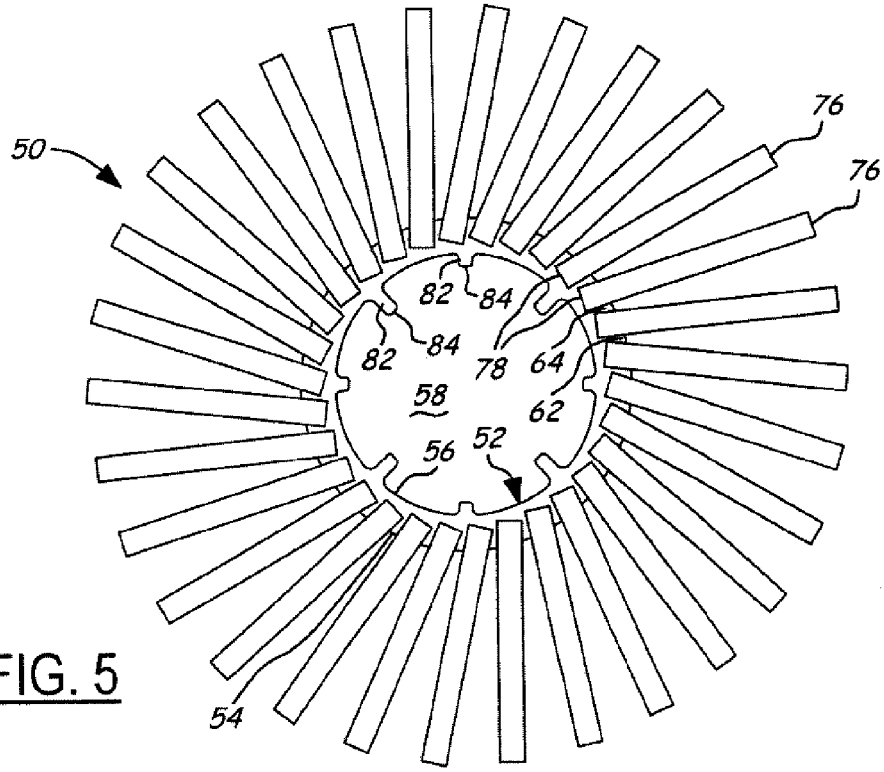
FIG. 5 is a front view of the flap wheel shown in FIG. 4.
Figure 6:
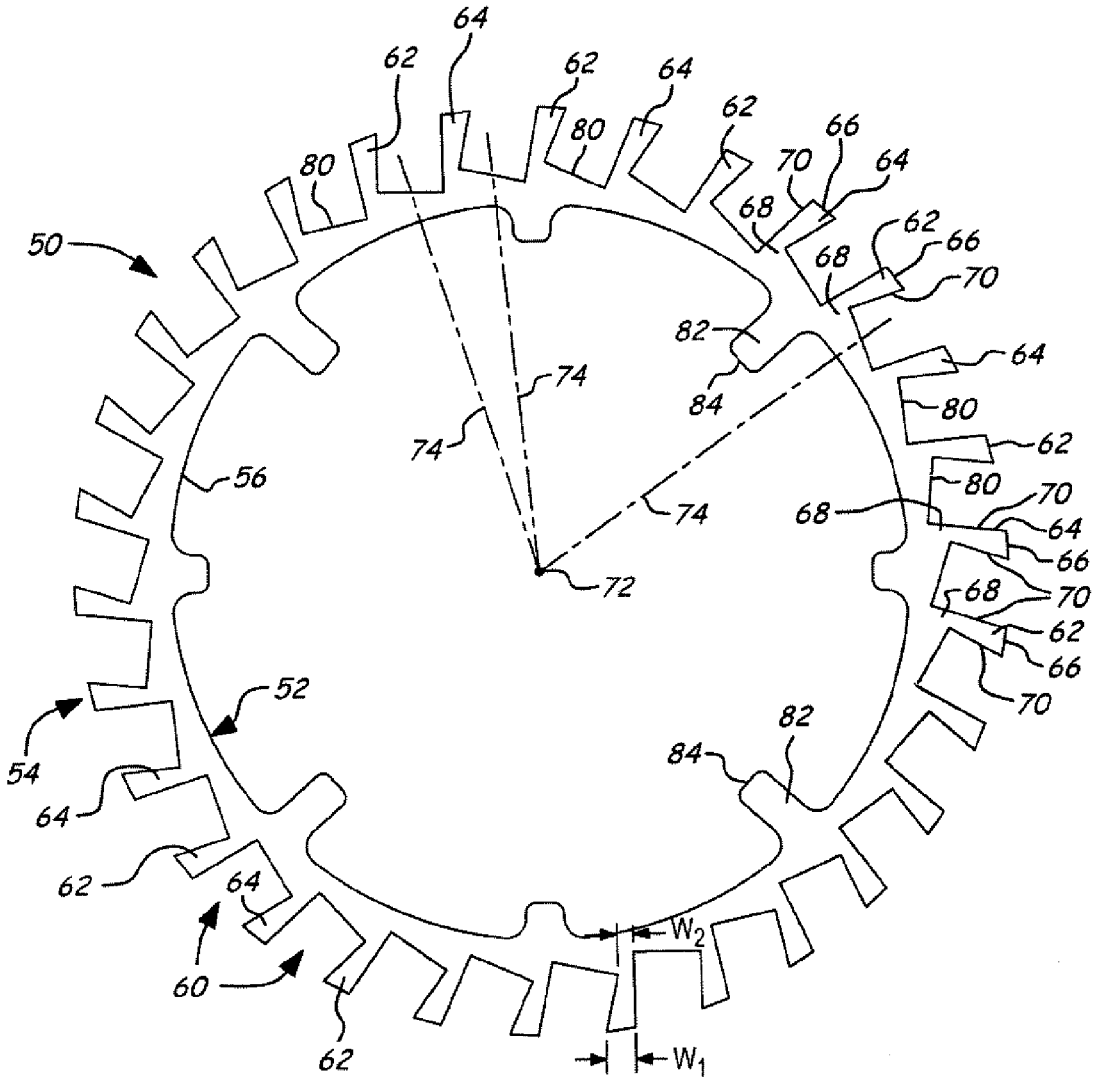
FIG. 6 is a front view of a generally cylindrical hub of the flap wheel shown in FIG. 4.
Figure 7:
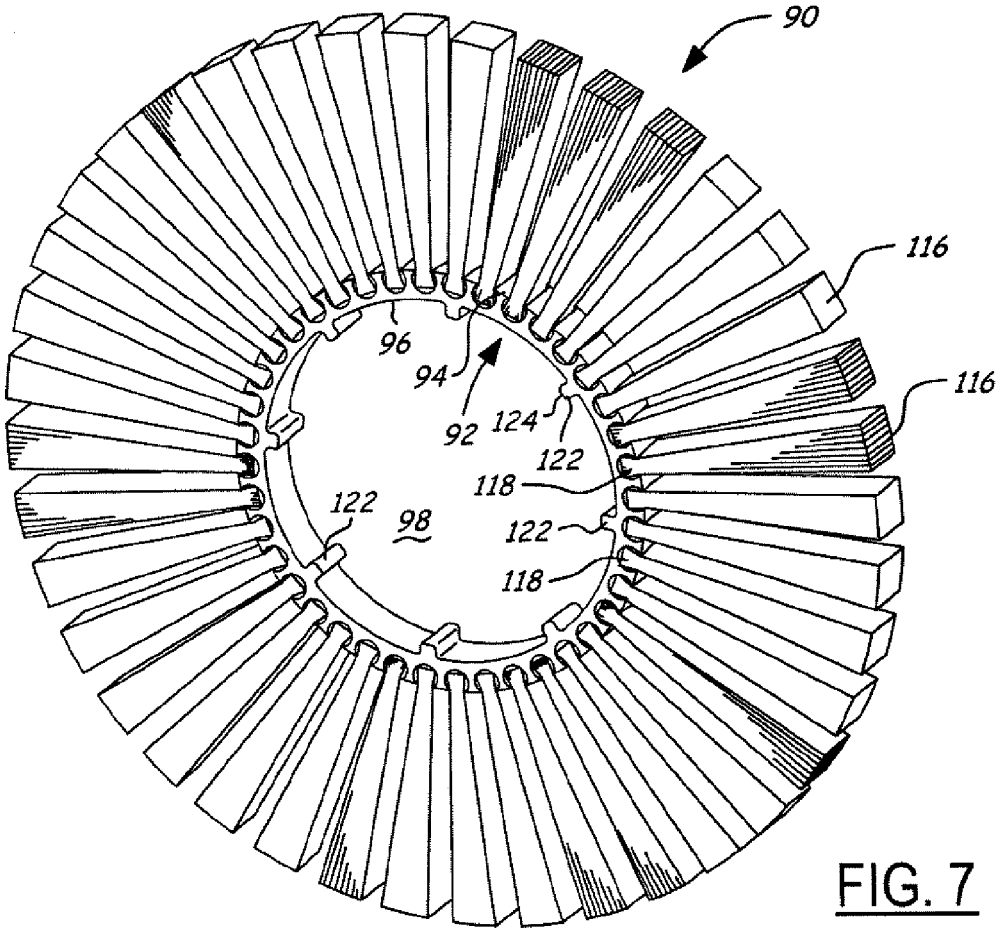
FIG. 7 is a perspective view of a flap wheel in accordance with yet another embodiment of the present invention.

FIGS. 4 through 6 illustrate another embodiment of a rotary finishing device in accordance with the present invention. The rotary finishing device 50 also includes a generally circular hub 52, having an outer peripheral surface or outer periphery 54, and an inner peripheral surface or inner periphery 56. The inner periphery 56 defines a passageway or throughhole 58 that is preferably open to either side of the device 50. Again, while the circular hub 12 is preferably formed from a metal, such as aluminum through an extrusion process, it can be formed from a variety of different materials, through different processes, and in a variety of different sizes and dimensions.

The outer periphery 54 of the device 10 includes a plurality of slots 60 formed thereabout. In this embodiment, the slots 60 are defined by a pair of side portions 62, 64 that extend generally inward from the outer periphery 54. Again, it will be understood by one of ordinary skill in the art that the side portions 62, 64 of each of the slots 60 can extend in a variety of different directions, including outwardly and can take on a variety of different configurations. As shown best in FIG. 6, each side portion 62, 64 includes a tip portion 66, a base portion 68, and a side surface 70 extending between the base portion 68 and the tip portion 66. Again, in this embodiment, the tip portions 66 have a greater width (w1) than the width (w2) of the base portions 68. This orientation assists in maintaining the side surfaces 70 generally parallel to one another such that each slot 60 is generally square or rectangular in shape.

Additionally, the circular hub 52 has a center point or centerline 72, which corresponds to the axis of rotation of the device 50. A reference line exists that extends from the center point 72 to a point between the pair of side portions 62, 64, as is identified by number 74. When the reference line 74 continues outwardly, it passes between each of the side portions 62, 64. Here, the side surfaces 70 are configured in a non-parallel orientation with respect to the reference line 74. In other words, the side portions 62, 64 are oriented at an angle with respect to the outer periphery 54.

Each of the slots 60 includes a finishing media 76 disposed therein. The finishing media 76 may be comprised of a single sheet of material or a plurality of sheets of material. The finishing media 76 is intended to contact a surface to be finished. The finishing media 76 is disposed between a pair of side portions 62, 64 and its innermost portion 78 is located adjacent the outer periphery 54 of the device 50. In one embodiment, the finishing media 76 is secured within each of the slots 60 by an adhesive, such as an epoxy. The adhesive secures the finishing media 76 within each slot 60 by affixing it to a bottom surface 80 that extends between and connects the base portions 68 of a pair of adjacent side portions 62, 64. Obviously, the finishing media 76 can be secured within each of the slots 60 in a variety of suitable manners.

In accordance with another embodiment of the present invention, the bottom surface 80 of the slots 60 and the pair of adjacent side portions 62, 64 are subjected to a surface treatment prior to attachment of the finishing media 76 within each slot 60. The surface treatment roughs up, abrades or otherwise prepares the contact surface to assist in adhering the finishing media to the hub 52. It will be understood that all or fewer than all of the contact surfaces may be subjected to the surface treatment. The surface treatment includes, but is not limited to etching, sand blasting, vibratory finishing, or a surface finish. It will be understood that other suitable surface treatments or surface finishings may be utilized.

The inner periphery 56 of the device 50 also includes a plurality of lugs 82 that extend generally inward therefrom. The lugs 82 allow for easy machining of the device 50 to true up the inside contact surface, by removing a certain portion of material from the tip 84 of at least some of the lugs 82. This provides significant material savings as well as a decrease in machining cost as only the lugs 82 require machining instead of the entire inner periphery 56 when that is used as the contact surface. The lugs 82 also allow the hub 52 to communicate with a shaft or end cap to allow easy driving thereof. It will be understood that the inner periphery 56 may alternatively be a generally smooth surface without any lugs. Moreover, any number of lugs may be utilized. For example, FIG. 14 illustrates a generally circular hub 52 having an outer periphery 54 and an inner periphery 56. The inner periphery 56 does not have any lugs, but instead is comprised of a smooth surface for engagement with another structure to effectuate driving of the device.

FIGS. 7 through 10 illustrate still another embodiment of a rotary finishing device in accordance with the present invention. The rotary finishing device 90 also includes a generally circular hub 92, having an outer peripheral surface or outer periphery 94, and an inner peripheral surface or inner periphery 96. The inner periphery 56 defines a passageway or throughhole 98 that is preferably open to either side of the device 90. Again, while the circular hub 92 is preferably formed from a metal, such as aluminum through an extrusion process, it can be formed from a variety of different materials, through different processes, and in a variety of different sizes.

The outer periphery 94 of the device 90 includes a plurality of slots 100 formed thereabout. In this embodiment, the slots 100 are defined by a pair of side portions 102, 104 that extend generally inward from the outer periphery 94. Again, it will be understood by one of ordinary skill in the art that the side portions 102, 104 of each of the slots 100 can extend in a variety of different directions, including outwardly and can take on a variety of different configurations. As shown best in FIG. 9, each side portion 102, 104 includes a tip portion 106, a base portion 108, and a side surface 110 extending between the base portion 108 and the tip portion 106. In this embodiment, each of the slots 100 is generally rounded or arcuate in shape.

Additionally, the circular hub 92 has a center point or centerline 112, which corresponds to the axis of rotation of the device 90. A reference line exists that extends from the center point 112 to a point between the pair of side portions 102, 104, as is identified by number 114. When the reference line 114 continues outwardly, it passes between each of the side portions 102, 104. The side portions 102, 104 are oriented in a non-parallel relationship to the reference line 114. However, the side portions 102, 104 lie in a parallel plane to the reference plane 114 (or generally parallel thereto) and extend from the outer periphery 94 in a generally perpendicular direction. In this embodiment, the side portions 102, 104 are also not oriented generally parallel to one another.

Each of the slots 100 includes a finishing media 116 disposed therein. The finishing media 116 may be comprised of a single sheet of material or a plurality of sheets of material. The finishing media 116 is intended to contact a surface to be finished. The finishing media 116 is disposed between a pair of side portions 102, 104 and its innermost portion 118 is located adjacent the outer periphery 94 of the device 90. In one embodiment, the finishing media 116 is secured within each of the slots 100 by an adhesive, such as an epoxy. The adhesive secures the finishing media 116 within each slot 100 by affixing it within the rounded slot. Obviously, the finishing media 116 can be secured within each of the slots 100 in a variety of suitable manners.

In accordance with still another embodiment of the present invention, the outer periphery 94 and the pair of side portions 102, 104 are subjected to a surface treatment prior to attachment of the finishing media 116 within each slot 100. The surface treatment roughs up, abrades, or otherwise prepares the contact surfaces to assist in adhering the finishing media to the hub 92. It will be understood that all or fewer than all of the contact surfaces may be subjected to the surface treatment. The surface treatment includes etching, sand blasting, vibratory finishing, and a surface finish. It will be understood that other suitable surface treatments or surface finishings may be utilized.

The inner periphery 96 of the device 90 also includes a plurality of lugs 122 that extend generally inwardly therefrom. The lugs 122 allow for easy machining of the device 90 to true up the inside contact surface, by removing a certain portion of material from the tip 124 of at least some of the lugs 122. This provides significant material savings as well as a decrease in machining cost as only the lugs 122 require machining instead of the entire inner periphery 96 when that is used as the contact surface. The lugs 122 also allow the hub 92 to communicate with a shaft or end cap 126 to allow easy driving thereof. It will be understood that the inner periphery 96 may alternatively be a generally smooth surface without any lugs. Moreover, any number of lugs may be utilized.

Figure 9:
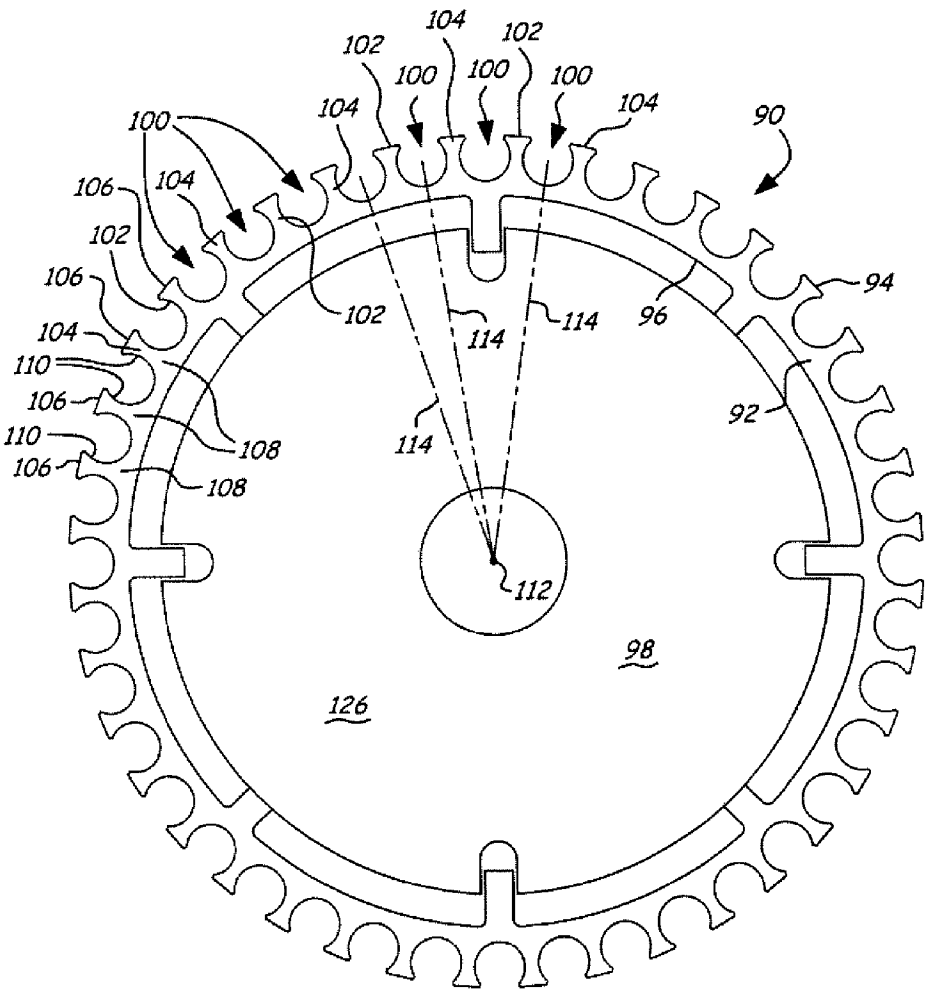
FIG. 9 is a front view of the generally cylindrical hub shown in FIG. 8 including an end cap engaging the hub.
Figure 10:
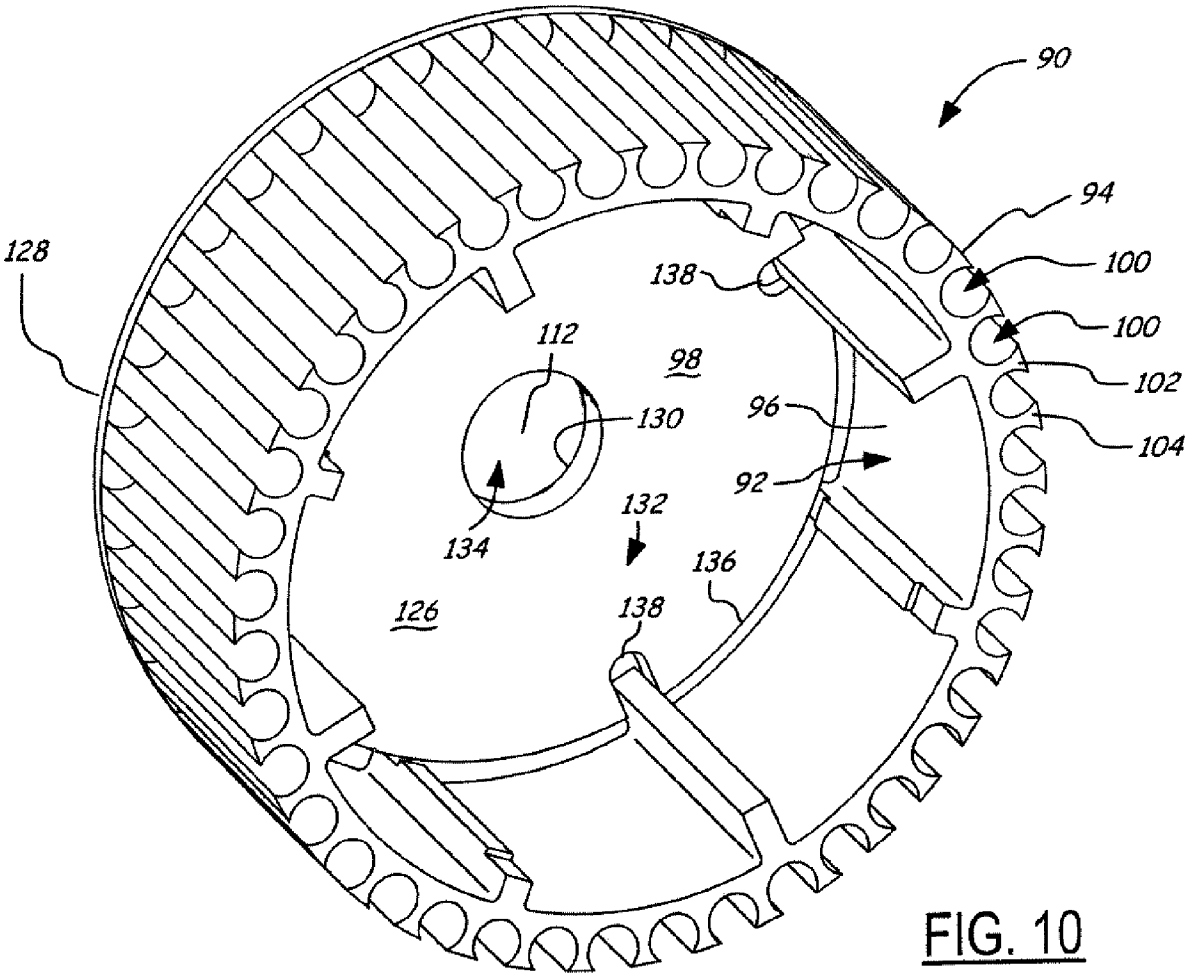
FIG. 10 is a perspective view of the generally cylindrical hub and end cap shown in FIG. 9.
Figure 11:
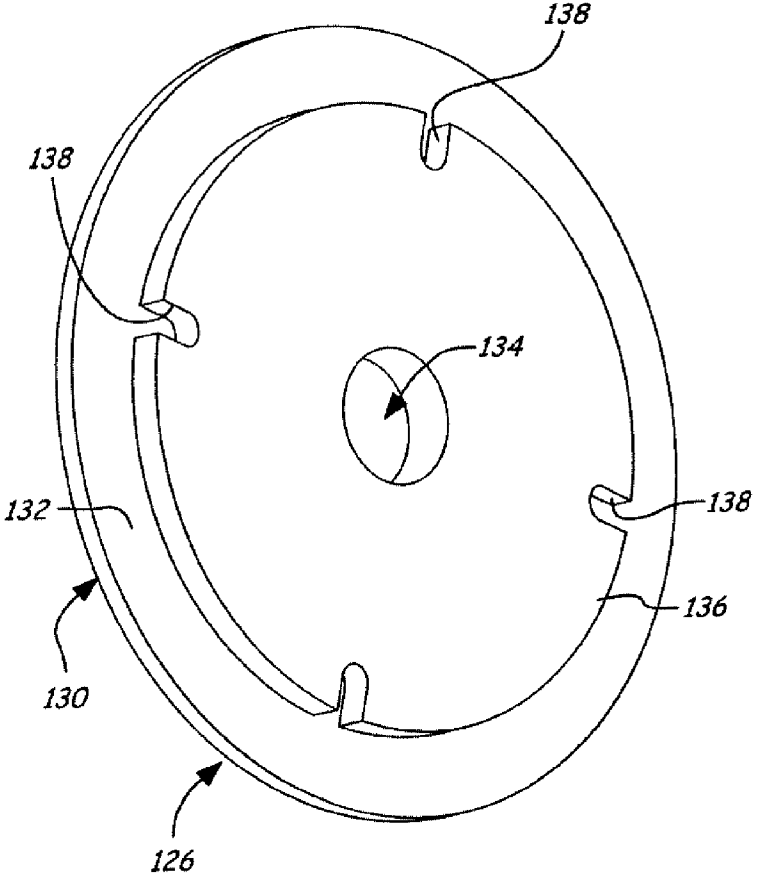
FIG. 11 is a perspective view of an end cap for attachment to a generally cylindrical hub of a flap wheel in accordance with one embodiment of the present invention.

Turning to FIGS. 9 through 11, which illustrate an end cap 126 for engagement with a rotary finishing device in accordance with the present invention. The end cap 126 is generally circular in shape and includes an outer perimeter 128, an outer side 130, an inner side 132, and an opening 134. The inner side 132 of the end cap 126 has an inner step 136 that is intended to be received in the throughhole 98 of the circular hub 92. In one embodiment, the inner step 136 includes a plurality of grooves 138 that are spaced about the periphery of the inner step 136. Each of the plurality of grooves 138 is intended to engage a respective one of the lugs 122. The end cap 126 is intended to receive a driving shaft through the opening 134. As the driving shaft rotates, it causes the end cap 126 to rotate, which is in communication with the finishing device through the lugs 122 causing it to rotate. It will be understood that the end cap 126 can take on a variety of configurations and can be configured to engage the circular hub 92 in a variety of different manners. For example, the end cap 126 can engage the circular hub 92 on the outer periphery 94. Alternatively, the inner periphery of the circular hub may be a generally smooth surface without lugs and the end cap may have a generally smooth inner step outer periphery to effectuate engagement with the circular hub, such as is exemplarily shown in FIG. 14.

Figure 13:
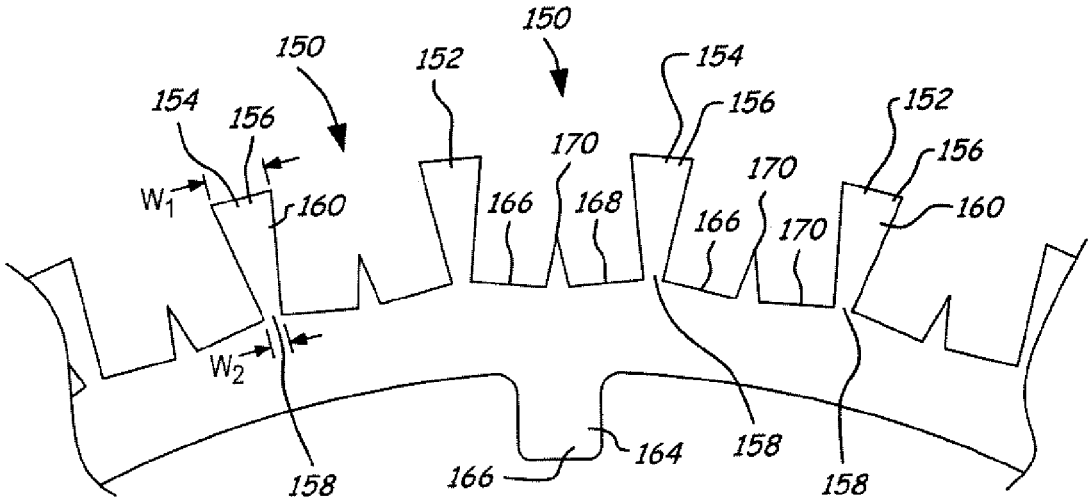
FIG. 13 is an enlarged view of a portion of the generally cylindrical hub shown in FIG. 12.
Figure 8:
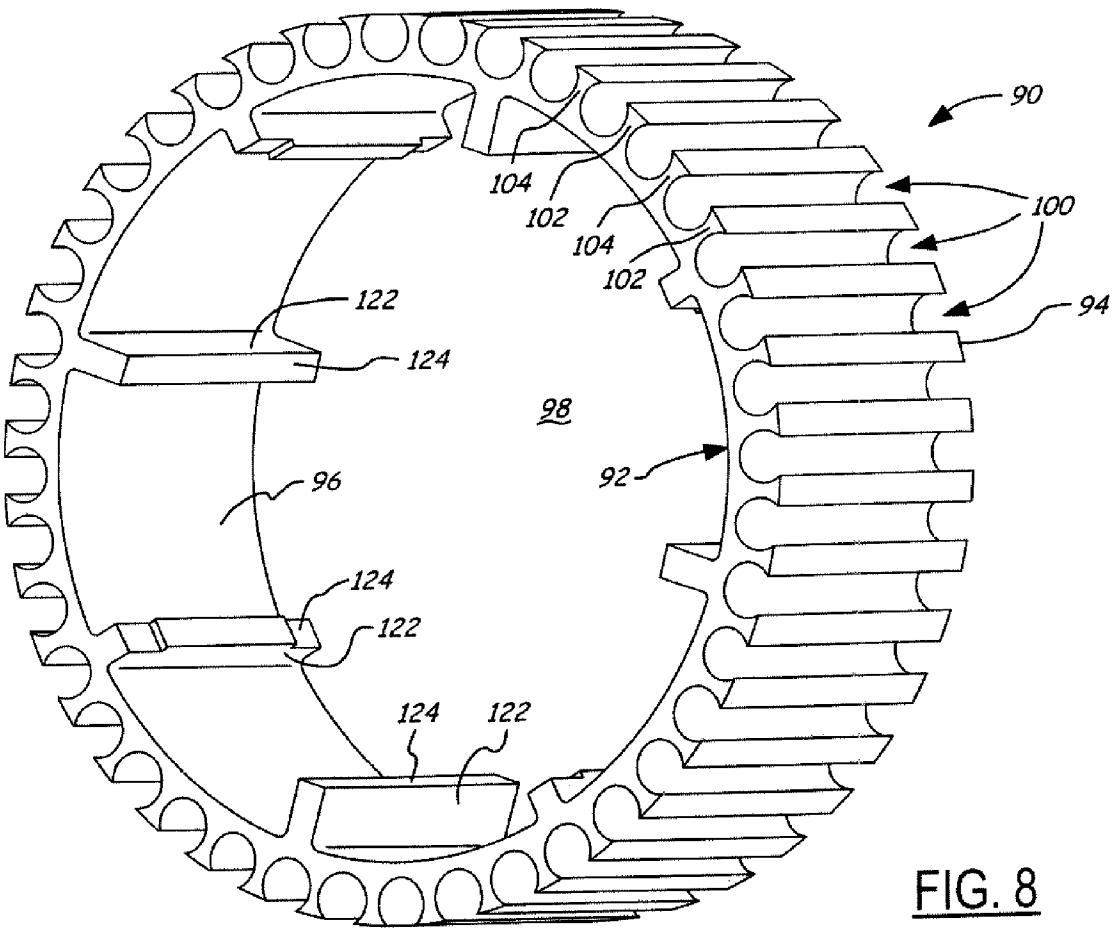
FIG. 8 is a perspective view of a generally cylindrical hub of the flap wheel shown in FIG. 7.
Figure 12:
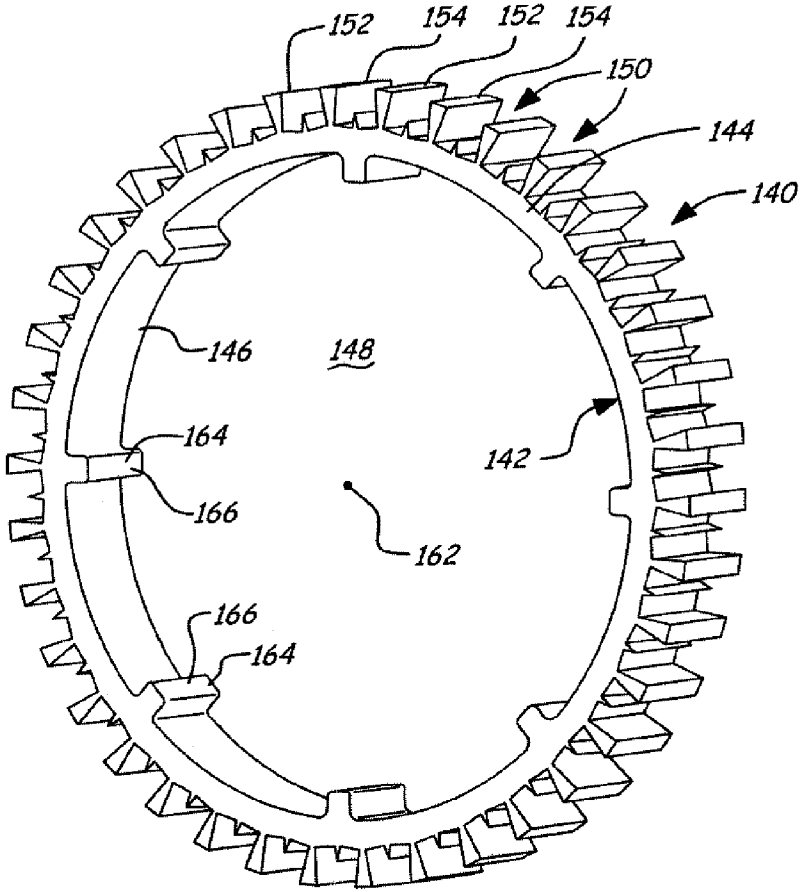
FIG. 12 is a perspective view of a generally cylindrical hub for a flap wheel, in accordance with still another embodiment of the present invention.

FIGS. 12 and 13 illustrate another embodiment of a rotary finishing device in accordance with the present invention. The rotary finishing device 140 also includes a generally circular hub 142, having an outer peripheral surface or outer periphery 144, and an inner peripheral surface or inner periphery 146. The inner periphery 146 defines a passageway or throughhole 148 that is preferably open to either side of the device 140. Again, while the circular hub 142 is preferably formed from a metal, such as aluminum through an extrusion process, it can be formed form a variety of different materials, through different processes, and in a variety of different sizes.

The outer periphery 144 of the device 140 includes a plurality of slots 150 formed thereabout. In this embodiment, the slots 150 are defined by a pair of side portions 152, 154 that extend generally outward from the outer periphery 144. Again, it will be understood by one of ordinary skill in the art that the side portions 152, 154 of each of the slots 150 can extend in a variety of different directions, including inwardly and can take on a variety of different configurations. Each of the slots 150 is intended to receive a finishing media that is secured in each slot 150 in the same manner discussed above.

As shown best in FIG. 13, each side portion 152, 154 includes a tip portion 156, a base portion 158, and a side surface 160 extending between the base portion 158 and the tip portion 156. Again, in this embodiment, the tip portions 156 have a greater width (w1) than the width (w2) of the base portions 158. In this embodiment, the side surfaces 160 are shaped such that the distance between opposing tip portions 156 is less than the distance between opposing base portions 158. The circular hub 142 also has a center point or centerline 162, which corresponds to the axis of rotation of the device 140. A reference line exists that extends from the center point 162 to a point between the pair of side portions 152, 154. The configuration of the reference line in this embodiment corresponds to the reference line in FIG. 3. Here, the side portions 152, 154 are oriented generally parallel to the reference line and thus are oriented generally perpendicular to the outer periphery 144. This is despite the fact that the side surfaces 160 are disposed at a slight angle with respect to the reference line.

Between each of the side portions 152, 154, the outer periphery 144 consists of a pair of inwardly sloping planar surfaces 166, 168. Each of these planar surfaces 166, 168 terminates at a point from which a wedge 170 extends. Accordingly, each of the slots 150 includes a wedge 170 extending outwardly from the outer periphery 144. Each wedge 170 is generally pointed and acts to spread the sheets of the finishing media apart so that they are wide at the base and cannot be easily pulled from the slot. The wedge 170 thus assists in retaining the finishing media within each of the slots 150.

Each of the slots 150 includes a finishing media (not shown) disposed therein. The finishing media may be comprised of a single sheet of material or a plurality of sheets of material. The finishing media is intended to contact a surface to be finished. The finishing media is disposed between a pair of side portions 152, 154 and its innermost portion is located adjacent the outer periphery 144 of the device 140. In one embodiment, the finishing media is secured within each of the slots 150 by an adhesive, such as an epoxy. The adhesive secures the finishing media within each slot 150 by affixing it within the rounded slot. Obviously, the finishing media can be secured within each of the slots in a variety of suitable manners.

In accordance with a further embodiment of the present invention, the outer periphery 144 and the pair of side portions 152, 154 can be subjected to a surface treatment prior to attachment of the finishing media within each slot 150. The surface treatment roughs up, abrades, or otherwise prepares the contact surfaces to assist in adhering the finishing media to the hub 142. It will be understood that all or fewer than all of the contact surfaces may be subjected to the surface treatment. The surface treatment includes etching, sand blasting, vibratory finishing, and a surface finish. It will be understood that other suitable surface treatments or surface finishings may be utilized.

The inner periphery 146 of the device 140 also includes a plurality of lugs 164 that extend generally inwardly therefrom. The lugs 164 allow for easy machining of the device 140 to true up the inside contact surface, by removing a certain portion of material from the tip 166 of at least some of the lugs 164. This provides significant material savings as well as a decrease in machining cost as only the lugs 164 require machining instead of the entire inner periphery 146 when that is used as the contact surface. The lugs 164 also allow the hub 142 to communicate with a shaft or end cap to allow easy driving thereof. It will be understood that the inner periphery may alternatively be a generally smooth surface without any lugs. Moreover, any number of lugs may be utilized.

Figure 15:
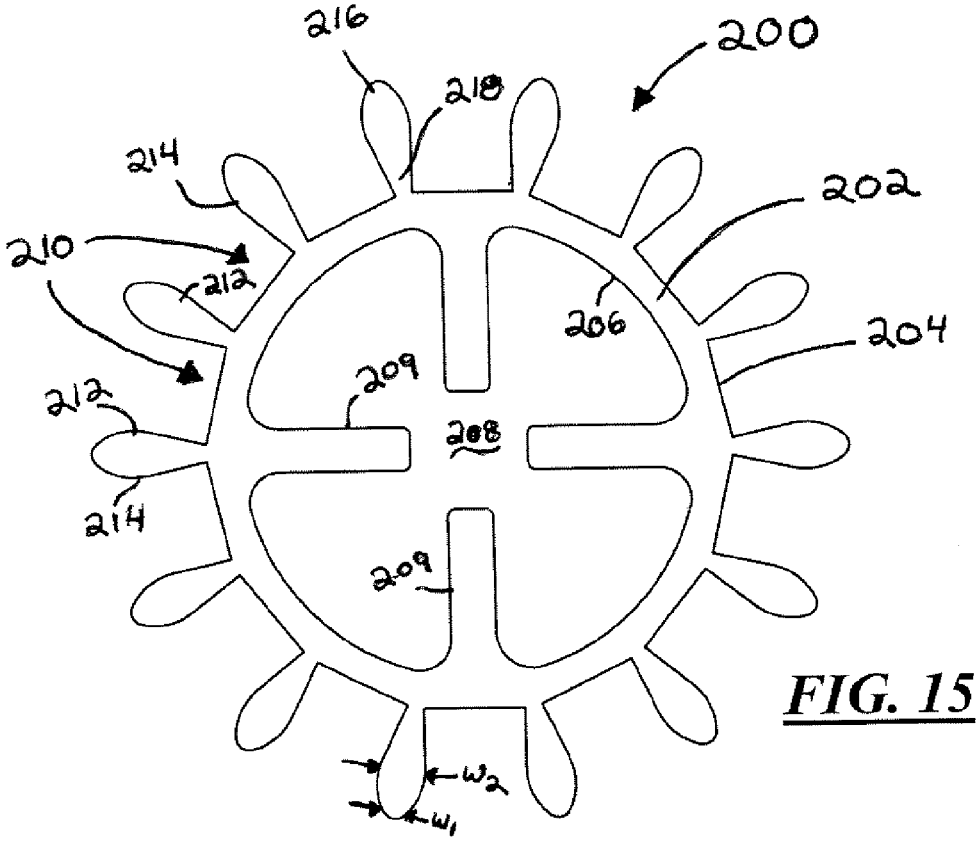
FIG. 15 is a front view of a cylindrical hub for a flap wheel in accordance with still yet a further embodiment of the present invention.

Referring now to FIG. 15, which illustrates yet another embodiment of a rotary finishing device in accordance with the present invention. The rotary finishing device 200 includes a generally circular hub 202, having an outer peripheral surface or outer periphery 204, and an inner peripheral surface or inner periphery 206. The inner periphery 206 defines a passageway or throughhole 208 that is preferably open to either side of the device 200. The inner periphery 206 also includes a plurality of lugs 209 that extend generally inwardly therefrom. As discussed above, the lugs 220 allow for easy machining of the device 200 as well as to accommodate various sized drive shafts and/or end caps. Again, while the circular hub 202 is preferably formed from a metal, such as aluminum through an extrusion process, it can be formed of a variety of different materials, through different processes, and in a variety of different sizes.

The outer periphery 204 of the device 200 includes a plurality of slots 210 formed thereabout. In this embodiment, the slots 210 are defined by a pair of side portions 212, 214 that extend generally outward from the outer periphery 204. Again, it will be understood by one of ordinary skill in the art that the side portions 212, 214 of each of the slots 210 can extend in a variety of different directions and take on a variety of different configurations. Each of the slots 210 is intended to receive a finishing media that is secured in each slot 210 in the same manner discussed above.

Each side portion 212, 214 includes a tip portion 216, a base portion 218, and a side surface 220 extending between the base portion 218 and the tip portion 216. In this embodiment, the tip portion 216 of each side portion 212, 214 is generally rounded. In other words, the tip does not contain a right angle at its connection with each side portion 212, 214. By eliminating these edges, any shear that can result from the finishing media contacting these edges when the device is in use is eliminated. Additionally, the tip portion 216 has a smaller width (w1) at its tip and increases to a greater width (w2) at some point at each side portion 212, 214. The width then decreases such that it is less than (w2) at the base portion 218. By this configuration, the side portions 212, 214 are generally parallel to one another from the base portion 218 generally to the point (w2). This acts as a funnel to assist in loading the finishing media into each slot 210. Each of the slots 210 is intended to receive a finishing media that is secured in each slot 210 in the same manner described above, including surface treating the contact surfaces of each slot.

Figure 16:
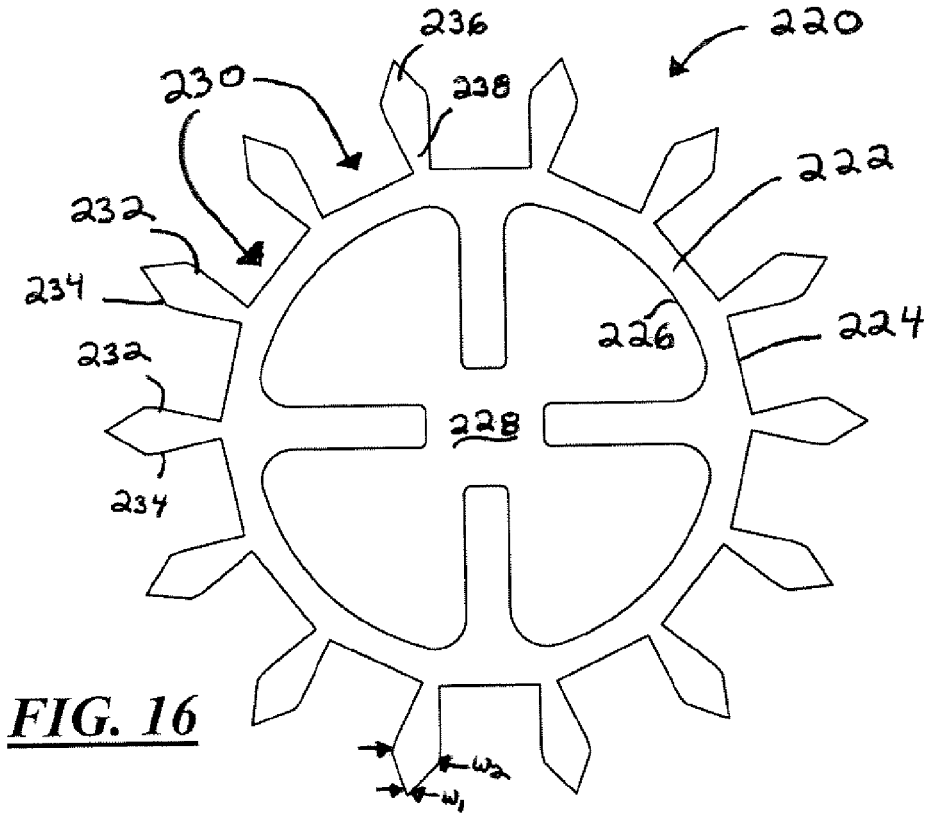
FIG. 16 is a front view of a cylindrical hub for a flap wheel in accordance with still yet another embodiment of the present invention.

FIG. 16 illustrates another embodiment of a rotary finishing device in accordance with the present invention. The rotary finishing device 220 includes a generally circular hub 222, having an outer peripheral surface or outer periphery 224 and an inner peripheral surface or inner periphery 226. The inner periphery 226 defines a passageway or throughhole 228 that is preferably open to either side of the device 220. Again, while the circular hub 222 is preferably formed from a metal, such as aluminum through an extrusion process, it can be formed from a variety of different materials, through different processes, and in a variety of different sizes.

The outer periphery 224 of the device 220 includes a plurality of slots 230 formed thereabout. In this embodiment, the slots 230 are defined by a pair of side portions 232, 234 that extend generally outwardly from the outer periphery 224. Again, it will be understood by one of ordinary skill in the art that the side portions 232, 234 of each of the slots 230 can extend in a variety of different directions and take on a variety of different configurations. Each of the slots 230 is intended to receive a finishing media that is secured in each slot 230 in the same manner discussed above, including by epoxy and/or surface finishing.

Each side portion 232, 234 includes a tip portion 236, a base portion 238, and a side surface 240 extending between the base portion 238 and the tip portion 236. In this embodiment, the tip portion 236 of each side portion 232, 234 is generally pointed. In other words, the tip does not contain a right angle at its connection with each side portion 212, 214. By eliminating these edges, any shear that can result from the finishing media contacting these edges when the device is in use is eliminated. While the point at the tip portion 216 is sharp, it does not provide the same shear effect as a sharp edge facing the sheets.

Additionally, the tip portion 236 has a smaller width (w1) at its tip and increases to a greater width (w2) at each side portion 232, 234. This acts as a funnel to assist in loading the finishing media into each slot 230. The width then decreases such that it isles than the width (w2) at the base portion 238. This assists in keeping the side portions 232, 234 generally parallel to one another from the base portion to the point (w2) where the tip portion 236 begins. Each of the slots 230 is intended to receive a finishing media that is secured in each slot 230 in the same manner described above, including surface treating the contact surfaces of each slot.

Figure 17:
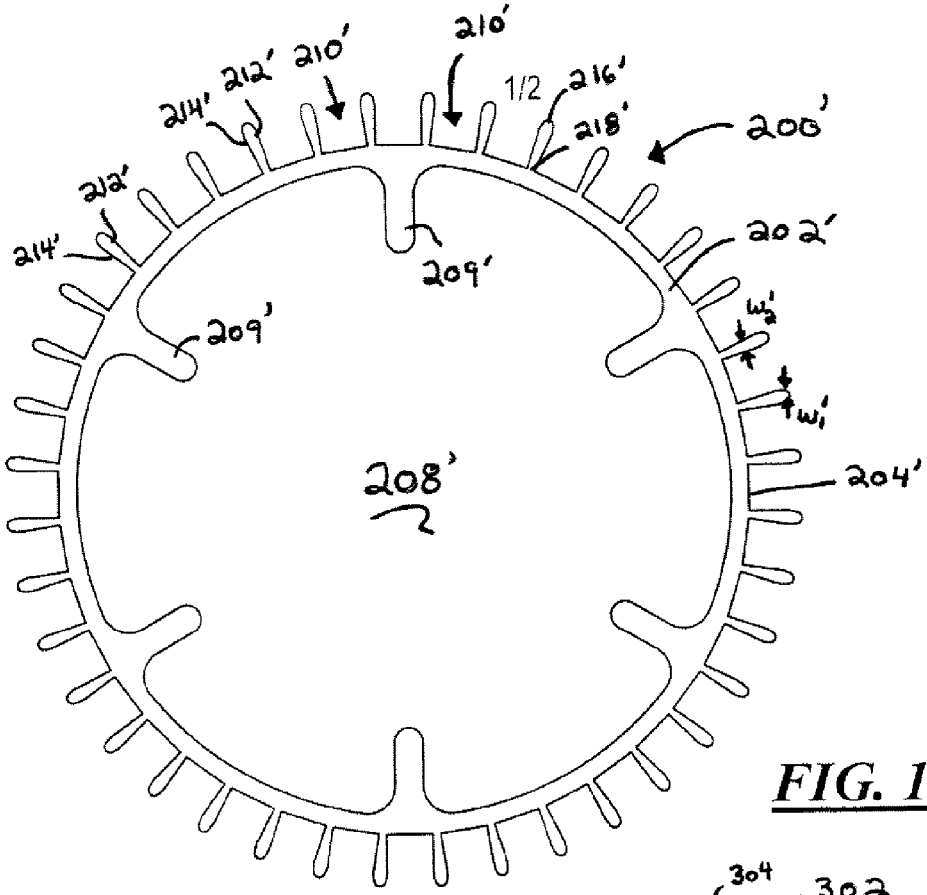
FIG. 17 is a front view of a cylindrical hub for a flap wheel in accordance with yet a further embodiment of the present invention.

FIG. 17 illustrates an embodiment of a rotary finishing device in accordance with the present invention. The rotary finishing device 200' is similar to the device 200 shown in FIG. 15. However, the side portions 212' and 214' of the slots 210' of the rotary finishing device 200' of FIG. 17 have a slightly different configuration than those illustrated in FIG. 15. The side portions 212, 214 and 212' and 214' in both embodiments each have a rounded tip portion 216, 216' in order to remove any sharp edges as well as any shear that can result from the finishing media contacting these edges when the device is in use. However, the distance (w2) between the side portions 212, 214 in FIG. 15 is greater than the distance (w2') between the side portions 212', 214' in FIG. 17. In other words, the distance difference between (w2)−(w1) in FIG. 15 is greater than the distance difference between (w2')−(w1') in FIG. 17.

Additionally, in accordance with the device rotary finishing device 200' illustrated in FIG. 17, the lugs 209' extend inwardly a much shorter distance than the lugs 209 in FIG. 15. This creates a larger passageway and allows for increased flexibility and provides for the incorporation of the present invention to devices of different sizes, diameters, and lengths. Further, the rotary device 200' of FIG. 17 has more lugs 209' than the embodiment of FIG. 15. Specifically, the device 200' includes six inwardly extending lugs 209'. Each of the slots 210' is intended to receive a finishing media. As will be understood from the above, the finishing media can be secured within each of the slots 210' by a variety of different ways, including epoxy and/or surface finishing.

Figure 18:
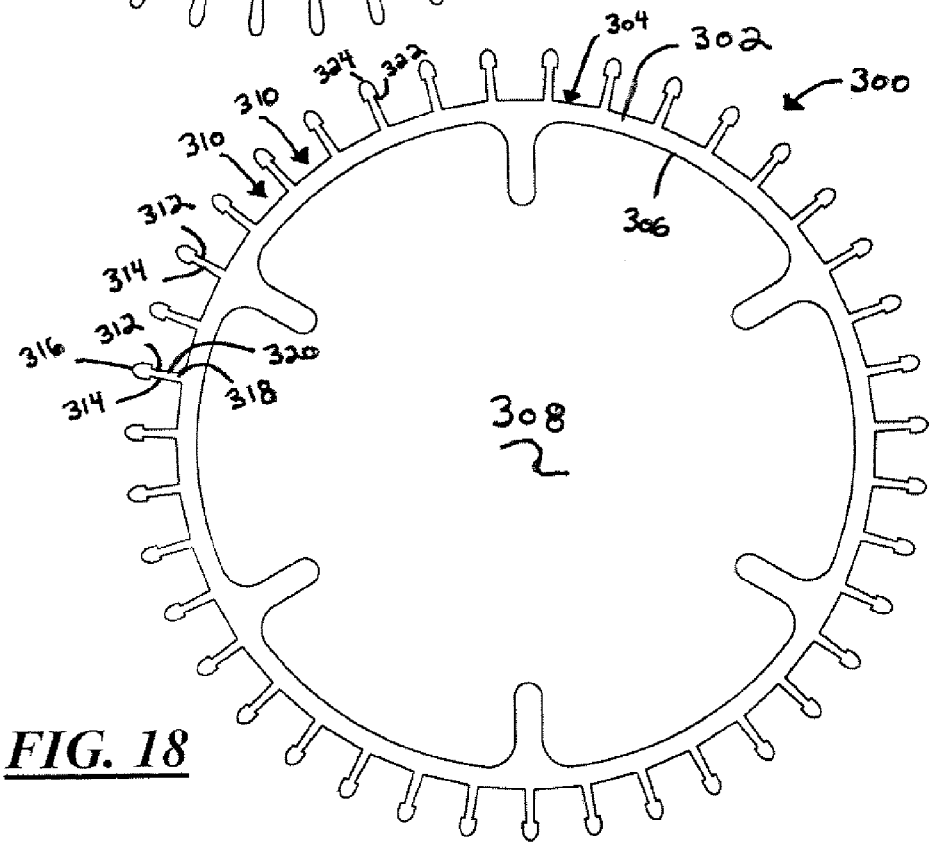
FIG. 18 is a front view of a cylindrical hub for a flap wheel in accordance with still yet a further embodiment of the present invention.

FIG. 18 illustrates still another embodiment of a rotary finishing device in accordance with the present invention. The rotary finishing device 300 includes a generally circular hub 302, having an outer peripheral surface or outer periphery 304 and an inner peripheral surface or inner periphery 306. The inner periphery 306 defines a passageway or throughhole 308 that is preferably open to either side of the device 300. Again, while the circular hub 302 is preferably formed from a metal, such as aluminum through an extrusion process, it can be formed from a variety of different materials, through different processes, and in a variety of different sizes.

The outer periphery 304 of the device 300 includes a plurality of slots 310 formed thereabout. In this embodiment, the slots 310 are defined by a pair of side portions 312, 314 that extend generally outwardly from the outer periphery 304. Again, it will be understood by one of ordinary skill in the art that the side portions 312, 314 of each of the slots 310 can extend in a variety of different directions and can take on a variety of different configurations. Each of the slots 310 is intended to receive a finishing media that is secured in each slot 310 in the same manner discussed above.

Each side portion 312, 314 includes a tip portion 316, a base portion 318, and a side surface 320 extending between the base portion 318 and the tip portion 316. In this embodiment, each tip portion 316 has a generally mushroom-shaped. By having a generally rounded mushroom-shaped tip 316, the tip is smooth and thus does not have any sharp edges that could contact the finishing media. By this configuration, any shear that can result from the finishing media contacting sharp edges when the device is in use is eliminated.

Further, each tip portion 316 has a bottom surface 322 that extends inwardly beyond either side portion 312, 314 such that the tip portion 316 extends slightly over the slot 310. The bottom surface 322 is generally perpendicular to each side portion 312, 314. While the corner where the rounded portion 324 meets the bottom surface 322 is sharp, it does not provide the same shear effect as a sharp edge facing the sheets. Further, because the tip portion 316 extends over the slots 310, it assists in retaining the finishing media in each slot.

FIGS. 19 through 24 illustrate various embodiments for the side portions and slots for a rotary finishing device as disclosed herein.

Figure 19:
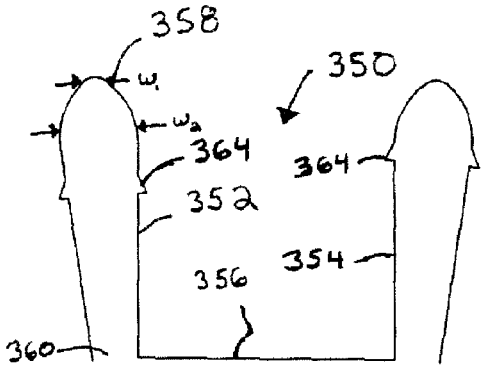
FIG. 19 is a schematic illustration of exemplary side portions of a slot for a cylindrical hub in accordance with another embodiment of the present invention.

Referring specifically to FIG. 19, which illustrates a slot 350 in accordance with another embodiment of the present invention. As set forth above, the slots 350 are each defined by a pair of side portions 352, 354 and a bottom surface 356 connecting each side portion 352, 354. In this embodiment, each side portion 352, 354 has a tip portion 358 and a bottom portion 360. The tip portion 358 of each side portion 352, 354 is generally rounded, which provides the advantages set forth above, including lack of shear due to the elimination of sharp edges. Further, each of the side portions 352, 354 slopes generally downwardly from the rounded tip portion 358 to the bottom portion 360.

The tip portion 358 has a smaller width (w1) at its tip and increases to a greater width (w2) adjacent the connection to each side surface 352, 354. This acts as a funnel to assist in loading the finishing media into each slot 350. The width then decreases such that the width at the bottom portion 360 is less than the width (w2). This assists in keeping the side portions 352, 354 generally parallel to one another from the bottom portion 360 to the point (w2) where the tip portion 358 begins. The slot 350 is intended to receive a finishing media that is secured in each slot 350 in the same manner discussed above, including surface treating the contact surfaces of each slot 350.

Each side portion 352, 354 has a protrusion or serration 364 formed thereon that assists in retaining the finishing media within the slot 350. The serrations 364, in this embodiment, are generally pointed or barbed. Additionally, as shown, the serration 364 formed in the side portion 354 is formed closer to the tip portion 358 than the bottom portion 360. It will be understood that these side portions can be utilized on a single rotary finishing device or can be utilized on multiple devices.

Figure 20:
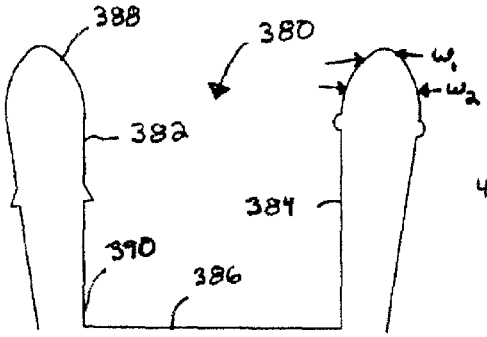
FIG. 20 is a schematic illustration of exemplary side portions of a slot for a cylindrical hub in accordance with still another embodiment of the present invention.

FIG. 20 illustrates another embodiment of a slot 380 in accordance with the present invention. As set forth above, the slots 380 are each defined by a pair of side portions 382, 384 and a bottom surface 386 connecting each side portion 382, 384. In this embodiment, each side portion 382, 384 has a tip portion 388 and a bottom portion 390. The tip portion 388 of each side portion 382, 384 is generally rounded, which provides the advantages set forth above, including lack of shear due to the elimination of sharp edges. Further, each of the side portions 382, 384 slopes generally downwardly from the rounded tip portion 388 to the bottom portion 390.

The tip portion 388 has a smaller width (w1) at its tip and increases to a greater width (w2) adjacent the connection to each side surface 382, 384. This acts as a funnel to assist in loading the finishing media into each slot 380. The width then decreases such that the width at the bottom portion 390 is less than the width (w2). This assists in keeping the side portions 382, 384 generally parallel to one another from the bottom portion 390 to the point (w2) where the tip portion 388 begins. The slot 380 is intended to receive a finishing media that is secured in each slot 380 in the same manner discussed above, including surface treating the contact surfaces of each slot 380.

Again, each of the side portion 382, 384 has a protrusion or serration 392, 394 formed thereon that assists in retaining the finishing media within the slot 380. The serrations, in this embodiment, have different configurations and are positioned at different heights. As shown, the serration 392 formed in the side portion 392 is formed generally in the middle thereof, while the serration 394 is formed in the side portion 384 closer to the tip portion 388. Additionally, the serration 394 is generally pointed or barbed, while the serration 396 is generally rounded. It will be understood that these side portions can be utilized on a single rotary finishing device or can be utilized on multiple devices.

Figure 21:
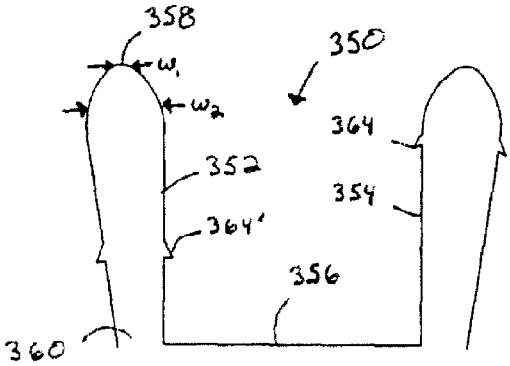
FIG. 21 is a schematic illustration of exemplary side portions of a slot for a cylindrical hub in accordance with a further embodiment of the present invention.

FIG. 21 illustrates another embodiment of the present invention. The embodiment of FIG. 21 is similar to the embodiment of FIG. 19. In FIG. 21, the serration 364' in the side portion 352 is located closer to the base portion 360 than the serration 264 in FIG. 19.

Figure 22:
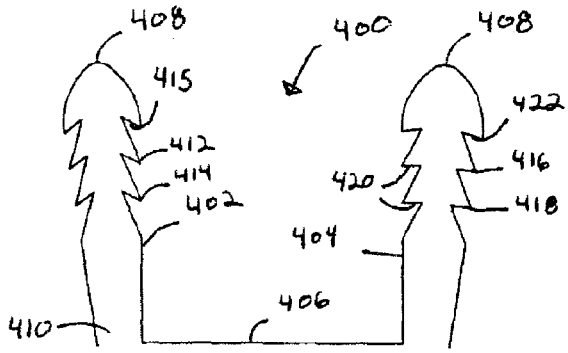
FIG. 22 is a schematic illustration of exemplary side portions of a slot for a cylindrical hub in accordance with yet another embodiment of the present invention.

Referring now to FIG. 22, which illustrates yet another embodiment of a slot 400 in accordance with the present invention. As set forth above, the slots 400 are each defined by a pair of side portions 402, 404 and a bottom surface 406 connecting each side portion 402, 404. In this embodiment, each side portion 402, 404 has a tip portion 408 and a bottom portion 410. The tip portion 410 of each side portion 402, 404 is generally rounded.

Each of the side portion 402, 404 has a plurality of barbs formed therein. Specifically, the side portion 402 has two barbs 412, 414. The barbs 412, 414 are angled generally downward with respect to the bottom surface 406. Additionally, the tip portion 408 above side portion 402 has an underside 415 that is angled generally downward with respect to the bottom surface 406. The side portion 404 has two barbs 416, 418. The barbs 416, 418 are oriented such that their undersides 420 are generally parallel to the bottom surface 406. Similarly, the underside 422 of the tip portion is also generally parallel to the bottom surface 406.

The tip portion 408 has a smaller width (w1) at its tip and increases to a greater width (w2) adjacent the connection to each side surface 402, 404. This acts as a funnel to assist in loading the finishing media into each slot 400. The slot 400 is intended to receive a finishing media that is secured in each slot 400 in the same manner discussed above, including surface treating the contact surfaces of each slot 400.

Figure 23:
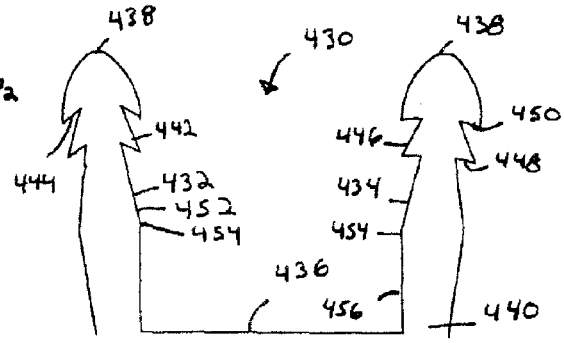
FIG. 23 is a schematic illustration of exemplary side portions of a slot for a cylindrical hub in accordance with still yet a further embodiment of the present invention.

FIG. 23 illustrates still another embodiment of a slot 430 in accordance with the present invention. As set forth above, the slots 430 are each defined by a pair of side portions 432, 434 and a bottom surface 436 connecting each side portion 432, 434. In this embodiment, each side portion 432, 434 has a tip portion 438 and a bottom portion 440. The tip portion 440 of each side portion 432, 434 is generally rounded.

Each of the side portion 432, 434 has a barb formed therein. Specifically, the side portion 432 has one barb 442, which is angled generally downward with respect to the bottom surface 436 of the slot 430. Additionally, the tip portion 438 above side portion 432 has an underside 444 that is angled generally downward with respect to the bottom surface 436. The side portion 434 has a barb 446. The barb 446 is oriented such that its underside 448 is generally parallel to the bottom surface 436. Similarly, the underside 450 of the tip portion 438 is also generally parallel to the bottom surface 436.

The tip portion 438 has a smaller width (w1) at its tip and increases to a greater width (w2) adjacent the connection to each side surface 432, 434. This acts as a funnel to assist in loading the finishing media into each slot 430. The slot 430 is intended to receive a finishing media that is secured in each slot 430 in the same manner discussed above, including surface treating the contact surfaces of each slot 430. Each side portion 432, 434 has a portion 452 that slopes generally inwardly as it extends downwardly from the barb 442, 446 to a point 454. The side portions 432, 434 each have a portion 456 that extends generally downwardly from the point 454 to the bottom surface 436. The portions 456 are generally parallel to one another.

Figure 24:
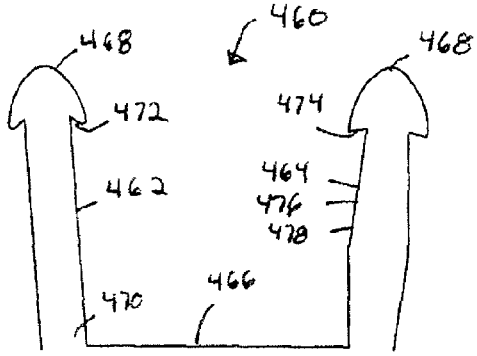
FIG. 24 is a schematic illustration of exemplary side portions of a slot for a cylindrical hub in accordance with still yet another embodiment of the present invention.

FIG. 24 illustrates yet a further embodiment of a slot 460 in accordance with the present invention. As set forth above, the slots 460 are each defined by a pair of side portions 462, 464 and a bottom surface 466 connecting each side portion 462, 464. In this embodiment, each side portion 462, 464 has a tip portion 468 and a bottom portion 470. The tip portion 468 of each side portion 462, 464 is generally rounded and has a generally mushroom shape.

The tip portion 468 has a smaller width (w1) at its tip and increases to a greater width (w2) adjacent the connection to each side surface 462, 464. This acts as a funnel to assist in loading the finishing media into each slot 460. The slot 460 is intended to receive a finishing media that is secured in each slot 460 in the same manner discussed above, including surface treating the contact surfaces of each slot 460.

The tip portion 468 of side portion 462 has an underside 472 that extends over the slot 460. Further, the underside 472 angles generally upwardly with respect to the bottom surface 466. The tip portion 468 of side portion 464 has an underside 474 that is generally parallel to the bottom surface 466.

The side portion 464 has a portion 476 that slopes generally inwardly as it extends downwardly from the tip portion underside 474 to a point 478. The side portion 464 then extends downwardly to the bottom portion 466.

While particular embodiments of the invention have been shown and described, numerous variations and alternate embodiments will occur to those skilled in the art. Accordingly, it is intended that the invention be limited only in terms of the appended claims.

What is claimed is:

1. A rotary finishing device, comprising:

a generally circular hub having an inner periphery and an outer periphery, said inner periphery defining a throughhole;

a plurality of slots formed about said outer periphery of said generally circular hub, each of said plurality of slots being defined by a pair of side portions extending from said outer periphery;

each of said pair of side portions including a tip portion, an intermediate portion, and a base portion;

a finishing media secured in each of said plurality of slots by an adhesive;

wherein each of said tip portions has an increased width as compared to said intermediate portion; and wherein each of said tip portion has a generally rounded apex.

2. The rotary finishing device of claim 1, wherein said generally circular hub is formed of a metal material.

3. The rotary finishing device of claim 2, wherein said generally circular hub is constructed of aluminum.

4. The rotary finishing device of claim 1, wherein said generally cylindrical hub is formed by an extrusion process.

5. The rotary finishing device of claim 1, wherein at least a portion of each of said plurality of slots is subjected to a surface treatment process to assist in bonding said finishing media to said generally circular hub.

6. The rotary finishing device of claim 1 wherein said side portions are further defined as rounded.

7. The rotary finishing device of claim 1 wherein said side portions are further defined as substantially straight.

8. The rotary finishing device of claim 1 wherein said side portions are further defined as mushroom shaped.

9. The rotary finishing device of claim 8 wherein an underside of said mushroom shape is generally parallel to a bottom of said slot.

10. The rotary finishing device of claim 8 wherein an underside of said mushroom shape is angled relative to a bottom of said slot.

11. A rotary finishing device comprising:

a generally circular hub having an inner periphery and an outer periphery, said inner periphery defining a throughhole;

a plurality of slots formed about said outer periphery of said generally circular hub, each of said plurality of slots being defined by a pair of side portions extending from said outer periphery, said plurality of slots being generally uniformly spaced around said generally circular hub;

said plurality of slots each having a finishing media secured therein by an adhesive;

a plurality of lugs disposed on said inner periphery and extending generally inwardly therefrom; and wherein each of said plurality of slots includes a serration formed therein to assist in adhering said finishing media to said generally circular hub.

12. The rotary finishing device of claim 11, wherein said generally cylindrical hub is formed of a metal material.

13. The rotary finishing device of claim 12, wherein said generally cylindrical hub is constructed of aluminum.

14. The rotary finishing device of claim 11, wherein said generally cylindrical hub is formed by an extrusion process.

15. The rotary finishing device of claim 11, wherein at least a portion of each of said plurality of slots is subjected to a surface treatment process to assist in bonding said finishing media to said generally circular hub.

16. The rotary finishing device of claim 11 wherein at least one of said serrations is disposed closer to a tip of said side portion than a bottom of said slot.

17. The rotary finishing device of claim 11 wherein at least one of said serrations is disposed substantially at a midpoint between a tip of said side portion and a bottom of said slot.

18. The rotary finishing device of claim 11 wherein at least one of said serrations is rounded.

19. The rotary finishing device of claim 11 wherein at least one of said serrations is disposed closer to a bottom of said slot than a tip of said side portion.

20. The rotary finishing device of claim 11 wherein a plurality of serrations project from at least one of said side portions.

21. The rotary finishing device of claim 11 wherein at least one of said serrations include an underside that is generally parallel to a bottom of said slot.

22. The rotary finishing device of claim 11 wherein at least one of said serrations include an underside that is angled relative to a bottom of said slot.

23. A rotary finishing device comprising:

a generally circular hub having an inner periphery and an outer periphery, said inner periphery defining a throughhole;

a plurality of slots formed about said outer periphery of said generally circular hub, each of said plurality of slots being defined by a pair of side portions extending from said outer periphery, said plurality of slots being generally uniformly spaced around said generally circular hub;

said plurality of slots each having a finishing media secured therein by an adhesive;

a plurality of lugs disposed on said inner periphery and extending generally inwardly therefrom; and wherein each of said plurality of slots includes a tip portion that has a generally rounded apex.

24. A rotary finishing device comprising:

a generally circular hub having an inner periphery and an outer periphery, said inner periphery defining a throughhole;

a plurality of slots formed about said outer periphery of said generally circular hub, each of said plurality of slots being defined by a pair of side portions extending from said outer periphery, said plurality of slots being generally uniformly spaced around said generally circular hub;

said plurality of slots each having a finishing media secured therein by an adhesive;

a plurality of lugs disposed on said inner periphery and extending generally inwardly therefrom, including a first plurality of lugs evenly circumferentially spaced around said inner periphery and a second plurality of lugs evenly circumferentially spaced around said inner periphery, wherein said first plurality of lugs have a different height than said second plurality of lugs; and an end cap receivable in said inner periphery and including a first plurality of grooves for individually receiving one of said first plurality of lugs and a second plurality of grooves for individually receiving one of said second plurality of lugs.

* * * * *